US005556214A

United States Patent [19]

Ascolese

[11] Patent Number: 5,556,214

[45] Date of Patent: Sep. 17, 1996

[54] MASCARA CASE FOR T-SHAPED APPLICATOR WAND

[75] Inventor: Salvatoare J. Ascolese, Edison, N.J.

[73] Assignee: Charbelle Ltd., Los Angeles, Calif.

[21] Appl. No.: 288,255

[22] Filed: Aug. 11, 1994

[51] Int. Cl.[6] ..... A45D 40/00; A56B 11/00

[52] U.S. Cl. ..... 401/126; 132/218; 401/122; 401/129

[58] Field of Search ..... 401/126, 122, 401/129, 277; 132/218; 215/350

[56] References Cited

U.S. PATENT DOCUMENTS

| | | | |
|---|---|---|---|
| 4,437,477 | 3/1984 | Gueret . | |
| 4,909,265 | 3/1990 | Goncalves | 401/277 X |
| 4,921,366 | 5/1990 | Hurrell . | |
| 5,141,347 | 8/1992 | Fitjer . | |
| 5,188,131 | 2/1993 | Toll . | |
| 5,190,389 | 3/1993 | Vasas | 401/122 |
| 5,309,929 | 5/1994 | Toll | 132/218 |

FOREIGN PATENT DOCUMENTS

| | | | |
|---|---|---|---|
| 379692 | 8/1990 | European Pat. Off. | 401/126 |
| 9012521 | 11/1990 | WIPO | 401/129 |

*Primary Examiner*—Steven A. Bratlie
*Attorney, Agent, or Firm*—Burns, Doane, Swecker & Mathis, L.L.P.

[57] ABSTRACT

A mascara case includes a vial for storing mascara, and a cap mountable on the vial for closing a passage of the vial. The passage is of oblong shape to accommodate insertion and removal of the transverse brush of a T-shaped wand carried by the cap. The cap also carries an oblong sealing ridge engageable with a sealing surface of the vial to surround an inlet of the passage. The cap carries a rotary knob which includes a projection positioned to engage a locking post disposed on the vial, in response to manual rotation of the knob. Engagement between the projection and locking post causes the cap and vial to be drawn together so that the sealing ridge forms an air-tight seal around the vial passage.

20 Claims, 4 Drawing Sheets

MASCARA CASE FOR T-SHAPED APPLICATOR WAND

BACKGROUND OF THE INVENTION

The present invention relates to mascara applicators and, in particular, to a mascara case for a T-shaped applicator wand.

A T-shaped mascara applicator wand (T-wand) and a case therefor are disclosed in U.S. Pat. Nos. 5,188,131 and 5,309,929 of Charlotte Toll. The wand comprises a stem and an applicator brush extending transversely of the stem. The case is comprised of a vial of elongated (oval) cross-sectional shape for containing the mascara, and a cover which functions as a handle for the applicator wand and as a cover for the vial.

It is desirable to produce an air-tight seal between the vial and cover in order to resist the evaporation of ethanol from the mascara and the resulting drying-out of the mascara. In the case of an in-line wand, i.e., wherein the applicator brush and the wand stem are colinear, the cover can be provided with a screw thread to enable the cover to be screwed onto the vial. The screw threads perform a camming action forcing the cover against the vial and a wiper disposed in the vial to enable a proper air-tight seal to be produced.

In the case of the T-wand and vial described in the above-mentioned patents, however, it is not possible for the brush to rotate within the vial. Thus, it is not possible to attach the cover to the vial by a screw thread unless the cover were made rotatable relative to the wand. That would, however, make it difficult to use the cover as a handle when applying the mascara, because the brush would tend to rotate out of its desired orientation during the application process.

It would be desirable, therefore, to provide a mascara case for a T-wand which enables an air-tight seal to be established between the cover and vial without making the cover rotatable relative to the wand.

SUMMARY OF THE INVENTION

The present invention relates to a mascara case which comprises a vial for storing mascara, the vial including a passage of oblong cross-section affording access to an interior of the vial, a first oblong sealing portion surrounding an inlet of the passage, and a first locking member. A cap is mountable on the vial for closing the passage. The cap includes a casing which carries a mascara wand defined by an axially extending stem and an applicator brush disposed at an end of the stem and extending generally transversely relative thereto. The cap further includes a second oblong sealing portion engageable in an axial direction with the first sealing portion for creating a seal around the passage. The cap further includes a second locking member. One of the first and second locking members (preferably the second locking member) is movable relative to the other and is engageable therewith for drawing the first and the second sealing portions axially together.

Preferably, the second sealing portion comprises a sealing ridge projecting axially toward the first sealing portion.

Preferably, the vial includes a body and a wiper mounted in the body. The wiper forms the passage, the passage being smaller in cross-section than the applicator brush for wiping excess mascara therefrom. The wiper includes a front surface which faces axially toward the sealing ridge for being sealingly engaged thereby.

The movable locking member preferably comprises a manually rotatable knob which is rotatable about an axis coinciding with an axis of the stem. The knob carries a projection which is engageable with the other locking member in response to rotation of the knob for creating a force drawing the cap, vial and wiper axially together.

The projection of the knob is preferably arranged to engage a locking member in the form of a locking post having a camming bevel which is contacted by the projection for creating the force which draws the cap and vial together.

The casing preferably includes a slot, and a portion of the outer circumference of the knob projects through the slot for engagement by a user.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF A PREFERRED EMBODIMENT OF THE INVENTION

Figure 1:
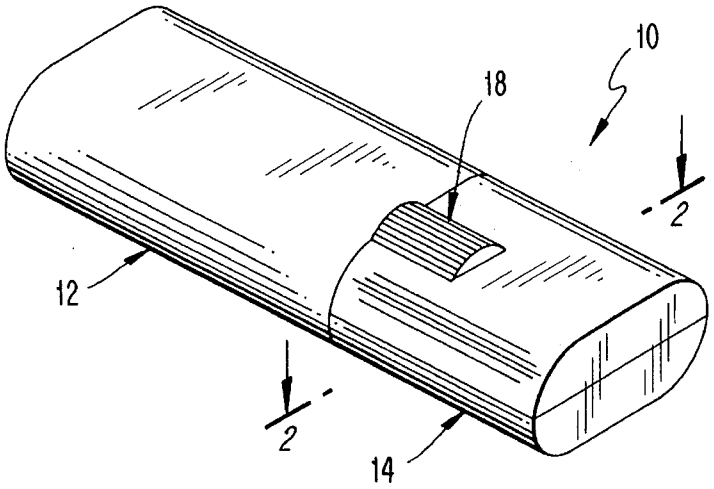
FIG. 1 is a front perspective view of a mascara case according to the present invention.
Figure 2:
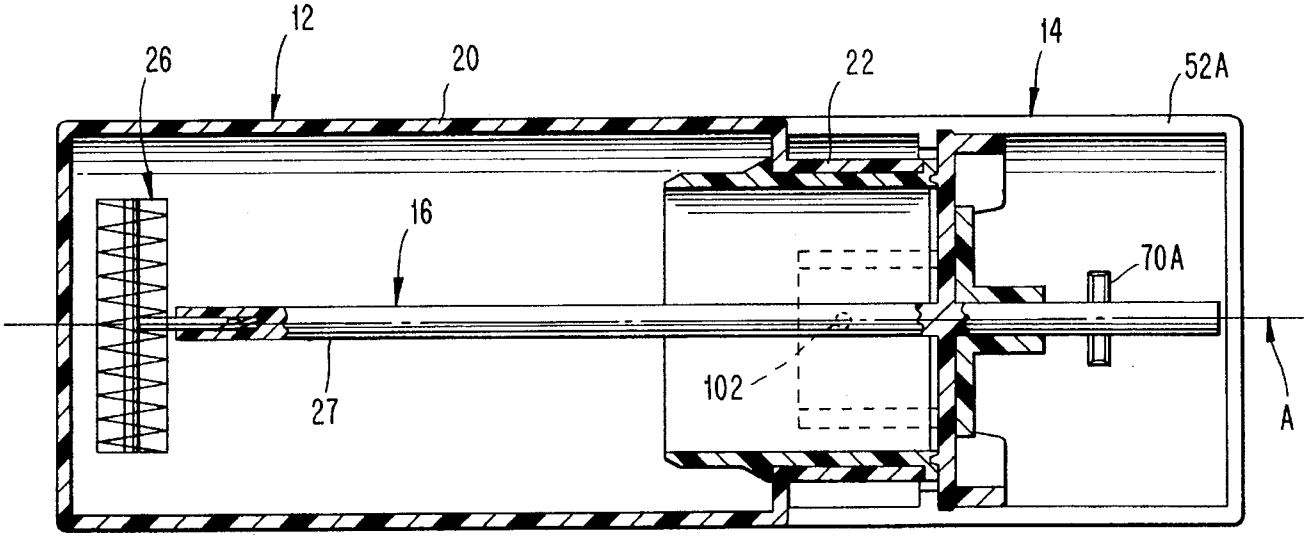
FIG. 2 is a longitudinal sectional view taken along the line 2—2 in FIG. 1, with a cap portion of the case being mounted on a vial portion of the case.

Depicted in FIG. 1 is a mascara case 10 which comprises a mascara-containing vial 12 and a removable cap 14. The cap carries a T-shaped wand 16 (see FIG. 2), and a locking knob 18 for securing the cap to the vial for creating an air-tight seal between the cap and vial.

Figure 5:
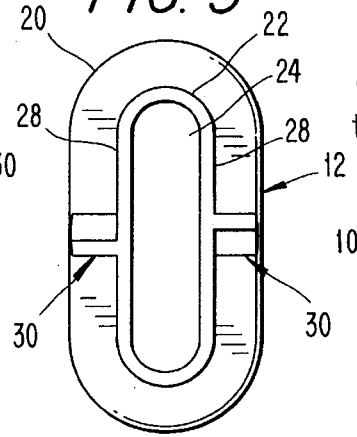
FIG. 5 is a front end view of the vial depicted in FIG. 4.
Figure 4:
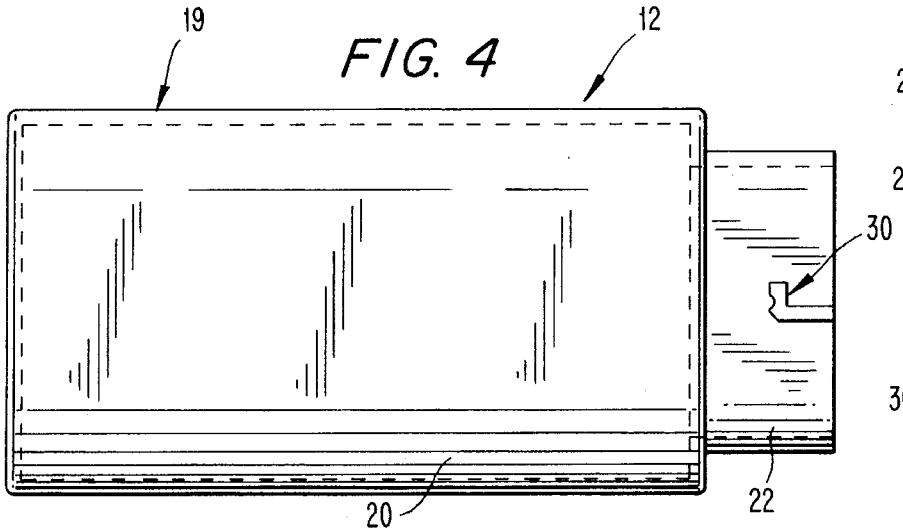
FIG. 4 is a top plan view of the vial portion of the case.

The vial 12 is formed of any suitable material, preferably a plastic such as p.v.c., and is preferably made by a conventional blow-molding procedure. The vial 12 includes a body 19 having a main portion 20 and a neck 22 of reduced cross section (see also FIGS. 4 and 5). The neck 22 forms an opening 24 of oblong configuration (see FIG. 5) for affording access of a transverse mascara applicator brush 26 of the wand 16, the brush 26 being mounted to a stem 27 of the wand.

Projecting outwardly from opposite sides 28 of the neck 22 are identical locking posts 30 which cooperate with the aforementioned locking knob 18 as will be hereinafter explained.

Figure 15:
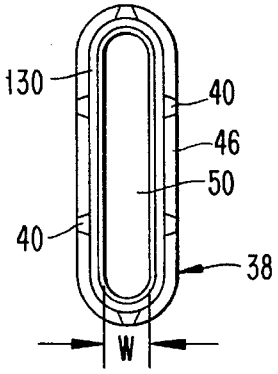
FIG. 15 is a rear elevational view of a wiper that is mounted in a body portion of the vial.

The vial includes a wiper 38 mounted within the neck 22 of the body, the wiper projecting into the main portion 29 (see also FIG. 15). The wiper member 38 can be formed of any suitable material, preferably a highly flexible material such as rubber or a soft plastic such as low density polyethylene. The wiper 38 is of oblong cross section (see FIG. 15) and lines the inside surface of the neck 22.

Installation of the wiper 38 is effected by pushing the wiper axially into the neck opening 24 until laterally outwardly projecting tabs 40 of the wiper extend past a shoulder 42 which joins the neck 22 to the main portion 20 of the body 19. A rear side 44 of each tab 40 is beveled to facilitate such installation, i.e., the wiper will be deformed, i.e., compressed as the tabs 40 pass through the neck 22, and will then snap out after the tabs travel past the shoulder 42. Axial inward movement of the wiper 38 is limited by an outward projecting flange 46 which engages the front end of the neck 22. Thus, the wiper 38 becomes secured within the neck 22.

The wiper 38 forms an oblong passage 50 sized to wipe excess mascara from the applicator brush 26 as the brush is pulled therethrough.

Figure 12:
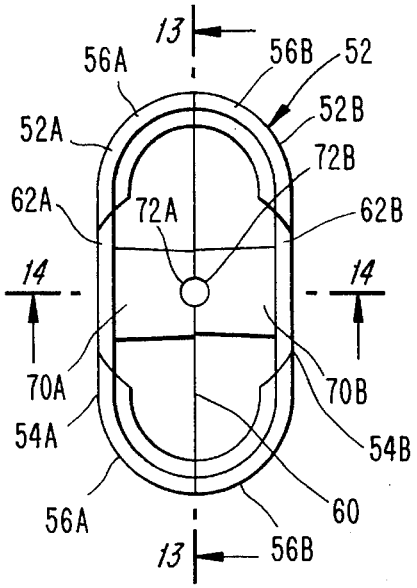
FIG. 12 is a front elevational view of a casing portion of the cap.
Figure 13:
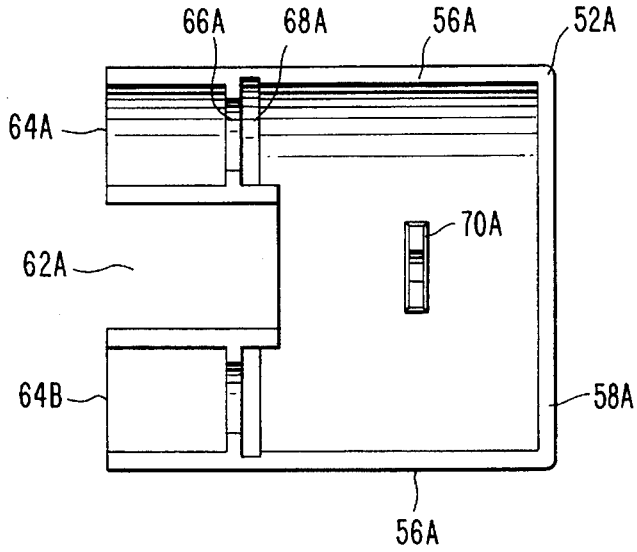
FIG. 13 is a view of one section of the casing portion taken along a line 13—13 in FIG. 12 which coincides with a parting line between the two sections of the casing portion.

The cap 14 includes a casing 52 formed by two casing sections 52A, 52B of identical configuration which are joined together, e.g., by an adhesive (see also FIGS. 6 and 12–14). Each casing section 52A, 52B includes a straight wall 54A, 54B having curved side portions 56A, 56B and a flat end wall 58A, 58B (see FIGS. 12 and 14). The two casing sections 52A, 52B are joined along a parting line 60 defined by the curved portions 56A, 56B and the end walls 58A, 58B. A front end of each casing section 52A, 52B includes a slot 62A, 62B formed in the straight wall 54A, 54B. Each slot 62A, 62B extends to a front edge 64A, 64B of the respective casing section 52A, 52B. At a location spaced axially rearwardly from the front edges 64A, 64B, each casing section includes a laterally inwardly projecting annular flange 66A, 66B which lies immediately in front of an annular groove 68A, 68B. Each flange and groove are interrupted by a respective slot 62A, 62B (as can be seen in FIG. 13).

Figure 14:
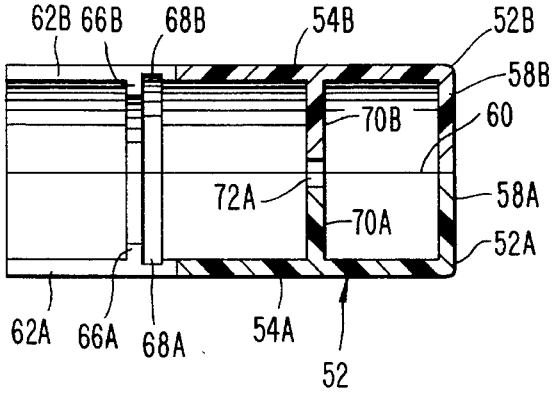
FIG. 14 is a sectional view taken along the line 14—14 in FIG. 12.

Located between the groove 68A, 68B and end wall 58A, 58B of each casing section 52A, 52B is a laterally inwardly projecting yoke 70A, 70B (see FIGS. 12, 14). Each yoke includes a concave end face 72A, 72B such that when the two casing sections 52A, 52B are joined together, the concave faces 72A, 72B are situated opposite one another to define a hole in which the stem 27 of the wand is fixed and held steady in any suitable manner, e.g., by being clamped between the yokes.

The casing sections 52A, 52B are formed of any suitable material, preferably a plastic such as polypropylene.

Figure 6:
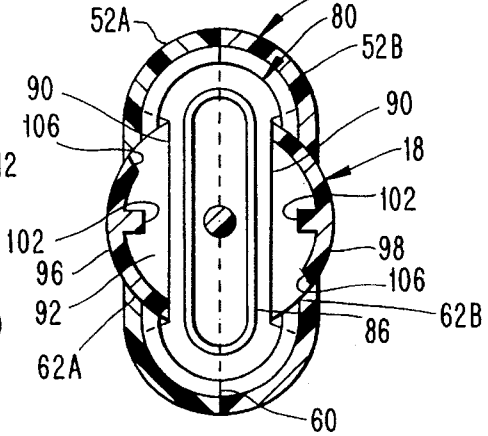
FIG. 6 is a sectional view taken along the line 6—6 in FIG. 3.
Figure 7:
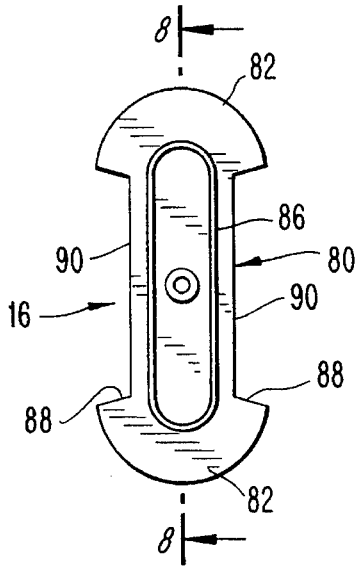
FIG. 7 is a front elevational view of a sealing plate according to the present invention.
Figure 8:
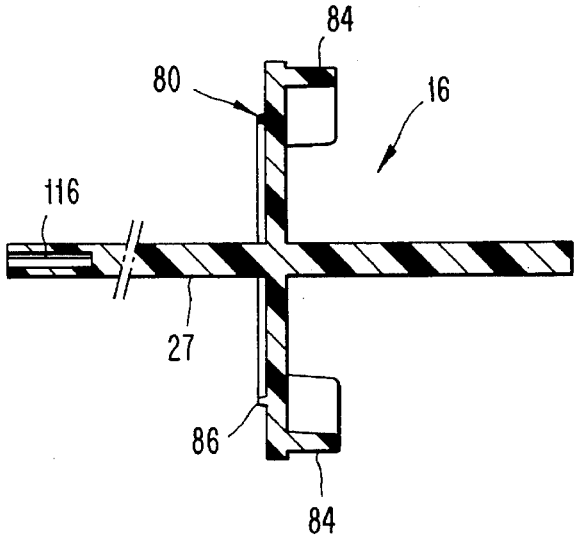
FIG. 8 is a sectional view taken along the line 8—8 in FIG. 7.
Figure 9:
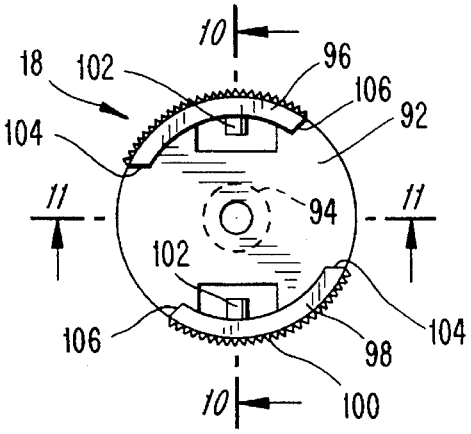
FIG. 9 is a front end view of a sealing knob according to the present invention.
Figure 10:
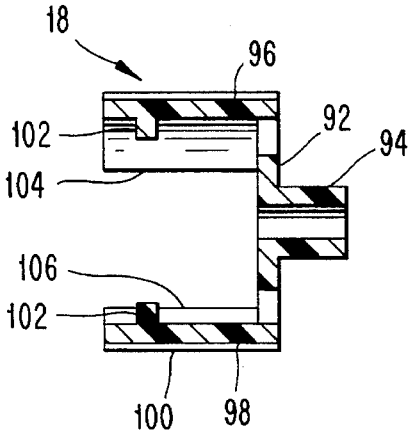
FIG. 10 is a sectional view taken along the line 10—10 in FIG. 9.
Figure 11:
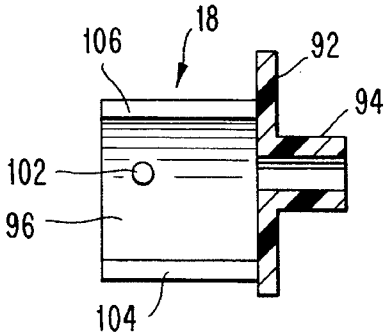
FIG. 11 is a sectional view taken along the line 11—11 in FIG. 9.

Mounted within the casing 52 is a sealing plate 80 which is of integral one-piece construction with the stem 27 of the wand 16 (see also FIGS. 6–8). The sealing plate 80 includes a pair of curved end portions 82 which fit into the grooves 68A, 68B so as to be secured against axial movement. An adhesive may be applied to enhance this securement. Curved flanges 84, which extend axially from respective ends 82 of the sealing plate 80, bear against an inside surface of the casing 52 to further support the sealing plate 80 against movement relative to the casing. A oblong sealing ridge 86 projects axially from a front surface of the sealing plate (see FIG. 7) to effect a sealing engagement with the wiper 38 as will be later explained. Disposed along each long side of the sealing plate 80 is a notch 88 having a base surface 90 for reasons to be discussed.

The sealing plate 80 can be formed of any suitable material, preferably a plastic such as Delrin®.

In order to secure the cap 14 to the vial 12, with the sealing ridge 86 pressed axially against the flange 46 of the wiper 38, the locking knob 18 has been provided (see FIGS. 2, 3 and 9–11). The locking knob 18 includes a disk 92 having a hub 94 which is mounted onto the stem 27 of the wand 16 so as to be rotatable relative to the wand about the longitudinal axis A of the stem 27.

Projecting axially from the disk 92 are a pair of arcuate legs 96, 98 which have knurling 100 along their outer peripheral surfaces to facilitate manual rotation by a user. Projecting radially inwardly from an inner surface of each of the legs 96, 98 is a cylindrical locking projection in the form of a peg 102, the pegs 102 being diametrically opposed to one another (see FIG. 9). The pegs are situated non-centrally with respect to the circumferential length of their respective legs, as is apparent from FIG. 9 which shows each leg extending circumferentially from its peg for a greater distance in the counterclockwise direction than in the clockwise direction.

Each of the legs 96, 98 includes two circumferentially spaced ends 104, 106 which function as stop surfaces for limiting the clockwise and counterclockwise rotation of the locking knob 18 as will be later explained.

Figure 3:
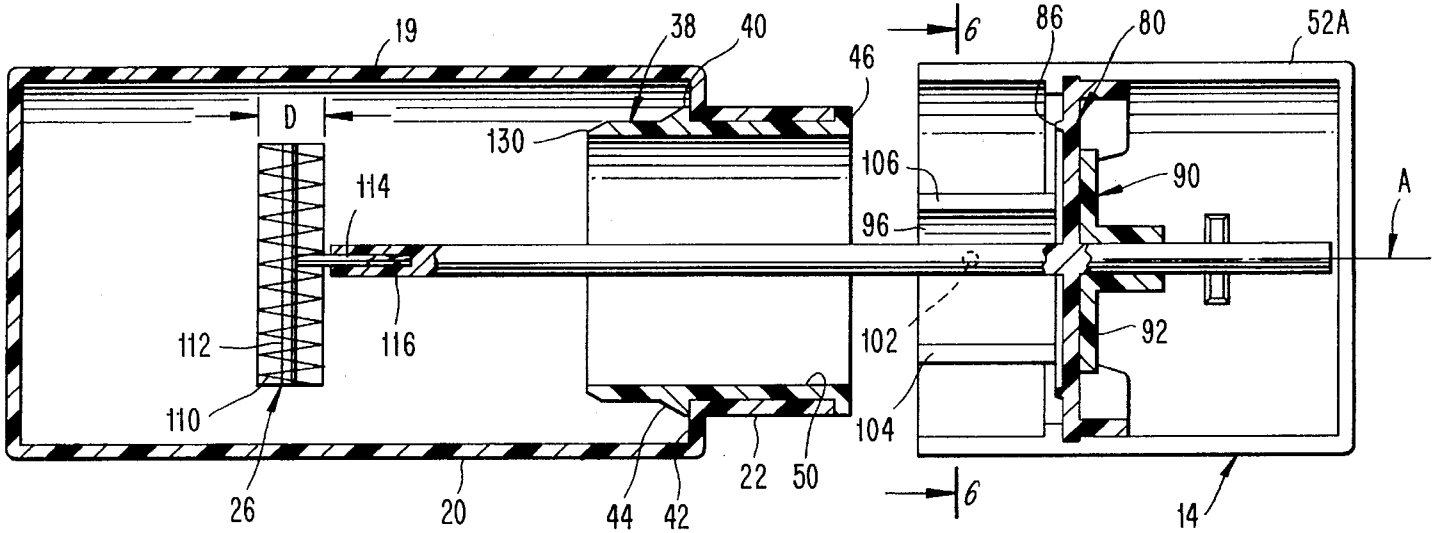
FIG. 3 is a view similar to FIG. 2 with the cap portion partially removed from the vial portion.

The locking knob 18 is positioned on the wand stem 27 such that the disk 92 is situated behind the sealing plate 80 (i.e., to the right of the sealing plate as viewed in FIG. 2), with the legs 96, 98 extending axially forwardly through respective ones of the notches 88 of the sealing plate as can be seen in FIGS. 3 and 6. As can be seen in FIGS. 1 and 6, the legs 96, 98 project through respective ones of the slots 62A, 62B of the casing sections 52A, 52B, so as to be engageable by fingers of the user.

The locking knob 18 can be formed of any suitable material, preferably a plastic such as polypropylene.

The applicator brush 26 is formed of conventional bristles preferably arranged in a spiral pattern 110 about a shaft 112 (see FIG. 3). Extending perpendicularly from a center of the shaft 112 is a finger 114, e.g. formed of metal, which fits into a bore 116 formed at an end of the wand stem 27. The finger 114 can be affixed in the bore 116 in any suitable fashion, e.g., by press fit and/or adhesive for example.

Figure 16A:
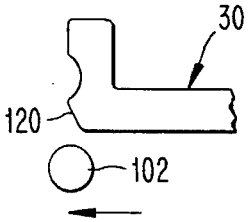
FIGS. 16A, 16B, and 16C are schematic views showing a sequence of steps involved in the engagement between a locking projection and a locking post of the mascara case for creating a sealing force ensuring that an airtight seal is formed around the passage of the vial.
Figure 16B:
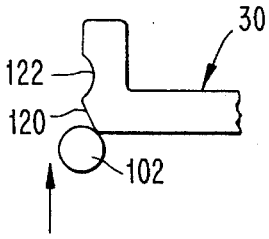

IN OPERATION, when the cap 14 is to be inserted onto the vial 12, the applicator brush 26 is aligned with the oblong passage 50 of the wiper 38. Then, the brush 26 is pushed through the passage 50, and simultaneously the neck 22 of the vial body enters the casing 52 of the cap 12. During that step, the locking knob 18 should be oriented such that the stop ends 106 of the legs 96, 98 are in contact with the base surface 90 of the notches 88 formed in the sealing plate 80. (Such an orientation is not depicted but would occur by rotating the locking knob 18 in the clockwise direction in FIG. 6.) As a result, the pegs 102 will be oriented so as to be able to travel axially alongside respective ones of the locking posts 30 (see FIG. 16A). Simultaneously, the sealing ridge 86 of the sealing plate 80 engages the flange 46 of the wiper 38. Then, the operator rotates the locking knob 18 until the stop ends 104 of the legs 96, 98 of that knob contact the base surfaces 90 of respective notches 88 formed in the sealing plate 80. (Such an orientation of the locking knob 18 is depicted in FIG. 6.) During a first portion of that rotation of the locking knob, each of the pegs 102 comes into contact with a camming bevel 120 formed on its associated locking post 30 (see FIG. 16B) and is cammed axially forwardly (i.e., to the left in FIGS. 2 and 16B) by that bevel 120 so that the sealing ridge 86 is pulled tightly against a front surface of the flange 46 of the wiper 38, thereby creating an air-tight seal around the inlet of passage 50.

Figure 16C:
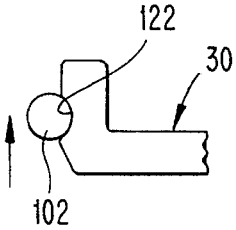

During a second portion of the rotation of the locking knob 18, the pegs 102 snap into concave recesses 122 formed in respective locking posts 30 (see FIG. 16C) to frictionally retain the locking knob 18 in its locked position. Thus, axial separation of the cap 14 from the vial 12 is prevented until the locking knob 18 is rotated in the opposite direction (counterclockwise with reference to FIG. 6) to return each peg 102 to the FIG. 16A position. When axial separation is to be performed, the applicator brush will be pulled through the passage 50 of the wiper 38. The width W of the passage 50 (see FIG. 15) is smaller than the diameter D of the brush, so excess mascara will be wiped from the brush by an end edge 130 (see FIG. 3) of the wiper. That end edge 130 is tapered to facilitate removal of mascara from the brush.

It will be appreciated that the present invention provides a mascara case for a T-shaped wand which secures the cap closed and creates an air-tight seal to prevent excessive drying-out of the mascara.

Although in the preferred embodiment of the invention the sealing ridge 86 is carried by the cap, it will be appreciated that, instead, the sealing ridge could be carried by the vial and arranged to be pressed against a surface carried by the cap.

Also, even though in the preferred embodiment of the invention, the locking posts 30 are carried by the vial, and the locking knob 30 is carried by the cap, their positions could be reversed whereby the locking knob would be mounted on the vial to be engageable with locking posts carried by the cap.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A mascara case, comprising:

a vial for storing mascara and including:

a passage of oblong cross section affording access to an interior of said vial, a first oblong sealing portion surrounding an inlet of said passage, and a first locking member; and a cap mountable on said vial for closing said passage, said cap including a casing having:

a mascara wand defined by an axially extending stem and an applicator brush disposed at an end of said stem and extending generally transversely relative thereto, a second oblong sealing portion engageable in an axial direction with said first sealing portion for creating a seal around said passage, and a second locking member, one of said first and second locking members being movable relative to the other of said first and second locking members and engageable therewith for drawing said cap and vial axially toward one another and thereby drawing said first and second sealing portions axially together.

2. The mascara case according to claim 1, wherein said second sealing portion comprises a sealing ridge projecting axially toward said first sealing portion.

3. The mascara case according to claim 2, wherein said vial includes a body and a wiper mounted in said body, said wiper forming said passage which is smaller in cross section than said applicator brush for wiping excess mascara from said brush, said wiper including a front surface facing axially toward said sealing ridge for being sealingly engaged thereby, said front surface defining said first sealing portion.

4. The mascara case according to claim 1, wherein said second locking member comprises said one locking member which is movable into engagement with the other locking member.

5. The mascara case according to claim 1, wherein said one locking member comprises a manually rotatable knob rotatable about an axis coinciding with an axis of said stem, said knob carrying a projection which is engageable with said other of said first and second locking members in response to rotation of said knob for creating a force drawing said cap and vial axially together.

6. The mascara case according to claim 5, wherein said other of said first and second locking members comprises a locking post having a camming bevel which is engaged by said projection for creating said force.

7. The mascara case according to claim 6, wherein said locking post further includes a recess disposed adjacent said camming bevel for capturing said projection and yieldably resisting rotation of said knob.

8. The mascara case according to claim 5, wherein said knob defines said second locking member disposed on said casing.

9. The mascara case according to claim 5, wherein said casing includes a slot, a portion of an outer circumference of said knob projecting through said slot for engagement by a user.

10. The mascara case according to claim 5, wherein said casing includes slots on opposite sides thereof, portions of an outer circumference of said knob projecting through respective ones of said slots for engagement by a user.

11. The mascara case according to claim 5, wherein said knob is rotatably mounted on said stem.

12. The mascara case according to claim 11, further including a sealing plate mounted in said casing and including a front surface carrying an oblong ridge facing toward said vial and defining said second sealing portion, said knob including a hub mounted on said stem adjacent a rear surface of said sealing plate and a leg projecting forwardly past said sealing plate, said leg carrying said projection.

13. The mascara case according to claim 12, wherein said leg includes circumferentially spaced ends engageable with said sealing plate for limiting rotation of said knob in both directions of rotation.

14. The mascara case according to claim 12, wherein said stem and sealing plate are of integral one-piece construction.

15. A mascara case comprising:

a vial including:

a body for storing mascara, said body including an outwardly projecting locking post, and a wiper mounted in said body and defining a passage of oblong cross section affording access to an interior of said body, said wiper formed of a material more flexible than that of said body and defining a sealing surface surrounding an inlet of said passage; and a cap mountable on said vial for closing said passage, said cap including:

a casing, a mascara wand disposed on said casing, said wand defined by an axially extending stem and an applicator brush disposed at an end of said stem and extending generally transversely relative thereto, an oblong sealing ridge disposed on said casing and projecting axially toward said sealing surface, and a manually rotatable locking knob mounted on said casing for rotation about an axis coinciding with an axis of said stem, said knob carrying a projection engageable with said locking post in response to rotation of said knob for drawing said cap and vial axially together to press said sealing ridge against said sealing surface.

16. The mascara case according to claim 15, wherein said locking post includes a camming bevel engageable by said projection for drawing said cap and vial axially together.

17. The mascara case according to claim 15, wherein said casing includes a slot, a portion of an outer circumference of said knob projecting through said slot for engagement by a user.

18. The mascara case according to claim 15, wherein said knob is rotatably mounted on said stem.

19. The mascara case according to claim 18, wherein there are two locking posts mounted on said body, said knob carrying two projections engageable with respective ones of said locking posts, said casing including two slots, two diametrically opposed portions of an outer circumference of said knob projecting through respective ones of said slots for engagement by a user.

20. A mascara case according to claim 18, further including a sealing plate of one-piece integral construction with said stem and extending perpendicularly to said axis, said sealing ridge disposed on an axially forwardly facing surface of said sealing plate, said knob including a hub rotatably mounted on said stem adjacent an axially rearwardly facing surface of said sealing plate, said knob further including a leg extending axially forwardly past said sealing plate, said projection mounted on said leg, said leg including circumferentially spaced ends engageable with said sealing plate for limiting rotation of said knob in both directions of rotation.

* * * * *